US006553806B1

(12) United States Patent
Reinert et al.

(10) Patent No.: US 6,553,806 B1
(45) Date of Patent: Apr. 29, 2003

(54) RECIPROCATION APPARATUS INCLUDING A GUIDE ASSEMBLY

(75) Inventors: Michael Anthony Reinert, Cincinnati, OH (US); Graham Price, Lawrenceburg, IN (US)

(73) Assignee: O.K.L. Can Line Inc., Cincinnati, OH (US)

( * ) Notice: Subject to any disclaimer, the term of this patent is extended or adjusted under 35 U.S.C. 154(b) by 45 days.

(21) Appl. No.: 09/834,994

(22) Filed: Apr. 13, 2001

(51) Int. Cl.[7] ..... B21D 22/28
(52) U.S. Cl. ..... 72/349; 72/456
(58) Field of Search ..... 384/12, 908; 72/347, 72/349, 456

(56) References Cited

U.S. PATENT DOCUMENTS

| | | | | |
|---|---|---|---|---|
| 2,593,230 A | | 4/1952 | Walter | |
| 2,604,363 A | | 7/1952 | Daugherty | |
| 2,815,252 A | | 12/1957 | Baker | |
| 3,168,013 A | | 2/1965 | Williamson | |
| 3,696,657 A | | 10/1972 | Maytag | |
| 3,735,629 A | | 5/1973 | Paramonoff | |
| 3,985,061 A | | 10/1976 | Montgomery | |
| 4,091,517 A | | 5/1978 | Lehmann et al. | |
| 4,173,138 A | | 11/1979 | Main et al. | |
| 4,226,483 A | | 10/1980 | Yamamoto | |
| 4,307,918 A | | 12/1981 | Mohsin | |
| 4,320,926 A | | 3/1982 | Heinemann et al. | |
| 4,457,566 A | | 7/1984 | Mohsin | |
| 4,504,096 A | | 3/1985 | Roch | |
| 4,530,228 A | | 7/1985 | Snyder et al. | |
| 4,578,981 A | | 4/1986 | Nishikawa et al. | |
| 4,614,104 A | | 9/1986 | Straw | |
| 4,620,805 A | * | 11/1986 | Belanger | 384/908 |
| 4,621,931 A | | 11/1986 | Jensen | |
| 4,934,167 A | | 6/1990 | Grims et al. | |
| 4,976,131 A | | 12/1990 | Grims et al. | |
| 5,052,278 A | | 10/1991 | Smillie, III et al. | |
| 5,096,348 A | | 3/1992 | Winkler et al. | |
| 5,138,862 A | | 8/1992 | Chasteen et al. | |
| 5,208,435 A | | 5/1993 | Main et al. | |
| 5,336,417 A | | 8/1994 | Hannum | |
| 5,421,653 A | | 6/1995 | Triplette | |
| 5,465,601 A | | 11/1995 | Jowitt et al. | |
| 5,572,891 A | | 11/1996 | Klein et al. | |
| 5,592,728 A | | 1/1997 | Susnjara | |
| 5,941,162 A | | 8/1999 | Kiesel | |
| 6,012,845 A | * | 1/2000 | Lyon | 384/12 |

OTHER PUBLICATIONS

HyComp® Inc.—FibreComp® Self–Lubricating Trimmer Spindle Bushings, May 2000.
HyComp®, Inc.—Vacuum and Air Manifolds, Apr. 1999.
HyComp®, Inc.—HyComp Materials—Wearcomp, p. 1, Mar. 26, 2001.

(List continued on next page.)

*Primary Examiner*—Lowell A. Larson
(74) *Attorney, Agent, or Firm*—Dinsmore & Shohl LLP

(57) ABSTRACT

Exemplary embodiments of a can body making apparatus include a frame, a contact member and a reciprocation assembly. The reciprocation assembly comprises a ram and a guide assembly. The contact member is for dynamically interfacing with at least a surface of the reciprocation assembly and comprises a material capable of withstanding a minimum PV value of 50,000 psi*ft/min without lubrication. Exemplary embodiments of a reciprocation apparatus are further provided that include a frame, a contact member and a reciprocation assembly. The reciprocation assembly includes an elongated member and a guide assembly. The guide assembly includes a main body portion and a removable cartridge. The cartridge houses the contact member and is adapted to secure the contact member relative to the guide assembly. The contact member is for dynamically interfacing with at least a surface of the reciprocation assembly. In addition, the contact member and cartridge are adapted for common insertion and removal relative to the main body portion of the guide assembly.

35 Claims, 5 Drawing Sheets

OTHER PUBLICATIONS

HyComp®, HyComp–Technical Data—Wearcomp, pp. 1–2, Mar. 26, 2001.
HyComp®, Inc.—HyComp–Technical Data–Fibrecomp, pp. 1–2, Mar. 26, 2001.
HyComp®, Inc.—HyComp–Products–Custom Bushings, p. 1, Mar. 26, 2001.
HyComp®, Inc.—HyComp–Products—Stock Plates, Rod Stock, Custom Bushings, Custom Shapes, pp. 1–2, Mar. 26, 2001.
HyComp®, Inc.—HyComp–Applications—Rolling Mill, Beverage Can, & Oil, pp. 1–2, Mar. 26 2001.
Tenmat Products—Feroform®–Self Lubricating Bearings, Fiberglide™–Self Lubricating Bearings, Feroglide—Self Lubricating Bearings, pp. 1–3, Mar. 26, 2001.
Sims Pump Valve Co., Inc.–Simsite®–Composites Bearings, pp. 1–2, Mar. 26, 2001.
Igus, Inc.—iglide® Design Guide—Innovaton With Polymers—Material Spec Overview, p. 1, Mar. 26, 2001.
Igus, Inc.—iglide® Design Guide—Innovation With Polymers—iglide® J Detailed Specs, pp. 1–3, Mar. 26, 2001.
Igus, Inc—iglide®–Innovation With Polymers—iglide® "Better Bearing Predictably", pp. 1–3, Mar. 26, 2001.
Igus, Inc.—iglide® T500, pp. 1–4: Mar. 26, 2001.
DryLin® R Design Guide—DryLin® R: Maintenance–free, dry running linear technology, pp. 1–2, Mar. 26, 2001.
Thomson™—XR Ball Bushing Bearing, p. 1, Mar. 26, 2001.
Thomson™—FluoroNyliner Bushing Bearing, p. 1, Mar. 26, 2001.
Thomson™—Nyliner Bushing Bearings, p. 1, Mar. 26, 2001.

* cited by examiner-

RECIPROCATION APPARATUS INCLUDING A GUIDE ASSEMBLY

TECHNICAL FIELD

This invention relates to a reciprocation apparatus, and more particularly to a guide assembly for a reciprocation apparatus.

BACKGROUND OF THE INVENTION

In the making of metal cans, such as aluminum cans of the type typically used for beverages, it is common practice to form the bodies of the cans from pre-drawn cup-shaped blanks in a body making apparatus. The cup-shaped blanks are transformed into can bodies by striking the blanks with a punch ram and forcing them through a series of progressive dies that, in essence, stretch and elongate the sidewalls of the blanks.

Typically, the can body making apparatus includes a conventional ram guide to guide the ram as it reciprocates relative to the frame of the apparatus. Known ram guides include lubricated bronze or brass bushings, rollers and hydrostatic fluid bearings. Applications that use lubricated bronze or brass typically require a constant supply of lubrication to avoid structural damage from excessive frictional heat. If the fluid supply is interrupted for whatever reason, expensive structural failure may result that will require significant down time to replace the damaged parts. In addition, replacing the bronze or brass contact surfaces can periodically require removal of the entire guide assembly to access the brass or bronze contact sleeves.

In another example, U.S. Pat. No. 4,976,131, the entire disclosure which is herein incorporated by reference, discloses a hydrostatic fluid bearing ram guide using high pressure liquid to reduce wear and misalignment of the ram. However, hydrostatic bearings of this nature require a high-pressure source that adds to capital expenditure and operating cost. The need for additional expensive parts (e.g., pump and motor, etc.) will increase the acquisition cost of the can body making apparatus. In addition, hydrostatic bearings have a relatively high energy consumption requirement to maintain the high-pressure fluid source during use. Hydrostatic bearings further require a complex fluid guidance system including opposing pockets or orifices to direct fluid to opposing surfaces of the ram. These pockets or orifices are prone to obstruction by system impurities, thereby causing system failure due to misalignment of the ram and/or excessive frictional heat.

U.S. Pat. No. 3,696,657, the entire disclosure which is herein incorporated by reference, discloses another conventional ram guide including rollers that follow inclined edge surfaces to guide the ram along a predetermined linear path. However, roller guides have a relatively short useful life due to excessive wear between the rollers and edge surfaces. Requiring maintenance and/or replacement of the rollers can also be expensive since the support mechanism must be lifted or removed to service the rollers. In addition, roller guides may require lubrication by fluid that cannot be recovered, thereby constantly requiring additional expense for providing fresh fluid and disposing used fluid.

SUMMARY OF THE INVENTION

Accordingly, it is an object of the present invention to address and obviate problems and shortcomings of conventional ram guides. More particularly, it is an object of the present invention to provide a guide assembly with a contact member formed of a material for increased part life.

It is a further object of the present invention to decrease heat generated and system power requirements for a reciprocation assembly.

It is another object of the present invention to simplify the maintenance of the guide assembly.

It is yet another object of the present invention to reduce down time for maintenance of the guide assembly.

To achieve the foregoing in other objects in accordance with the present invention, a can body making apparatus that includes a frame, a contact member and a reciprocation assembly. The reciprocation assembly comprises a ram mounted for reciprocation relative to the frame and a guide assembly adapted to guide the ram for reciprocation relative to the frame. The contact member is for dynamically interfacing with at least a surface of the reciprocation assembly. The contact member also comprises a material capable of withstanding a minimum PV value of 50,000 psi*ft/min without lubrication.

To achieve further objects in accordance with the present invention, a reciprocation apparatus is provided that includes a frame, a contact member and a reciprocation assembly. The reciprocation assembly includes an elongated member adapted to reciprocate relative to the frame and a guide assembly adapted to guide the elongated member. The guide assembly includes a main body portion and a removable cartridge. The cartridge houses the contact member and is adapted to secure the contact member relative to the guide assembly. The contact member is for dynamically interfacing with at least a surface of the reciprocation assembly. In addition, the contact member and cartridge are adapted for common insertion and removal relative to the main body portion of the guide assembly.

To achieve still further objects in accordance with the present invention a can body making apparatus is provided. The apparatus includes a frame, a ram supported relative to the frame, and a drive assembly adapted to linearly reciprocate the ram relative to the frame. The apparatus further includes a can holding mechanism for holding a can blank, a die pack, a contact member and a guide assembly adapted to guide the ram. The guide assembly includes a main body portion and a cartridge removably attached to the main body portion. The contact member is disposed in and restrained by the cartridge and the contact member and cartridge are adapted for common insertion and removal relative to the main body portion of the guide assembly.

Still other advantages and objects of the present invention will become apparent to those skilled in the art from the following description wherein there are shown and described alternative exemplary embodiments of this invention. These exemplary advantages and objects are provided only as illustrative examples, and in no way are intended, nor should they be interpreted, as limiting or the only advantages or objects. As will be realized, the invention is capable of other different, obvious aspects, objects and embodiments, all without departing from the scope of the invention. These other objects, aspects and embodiments will be understood by those skilled in the art based upon the description and teachings herein. Accordingly, the drawings, objects and descriptions should be regarded as illustrative and exemplary in nature only, and not as restrictive.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

DETAILED DESCRIPTION OF EXEMPLARY EMBODIMENTS

Figure 1:
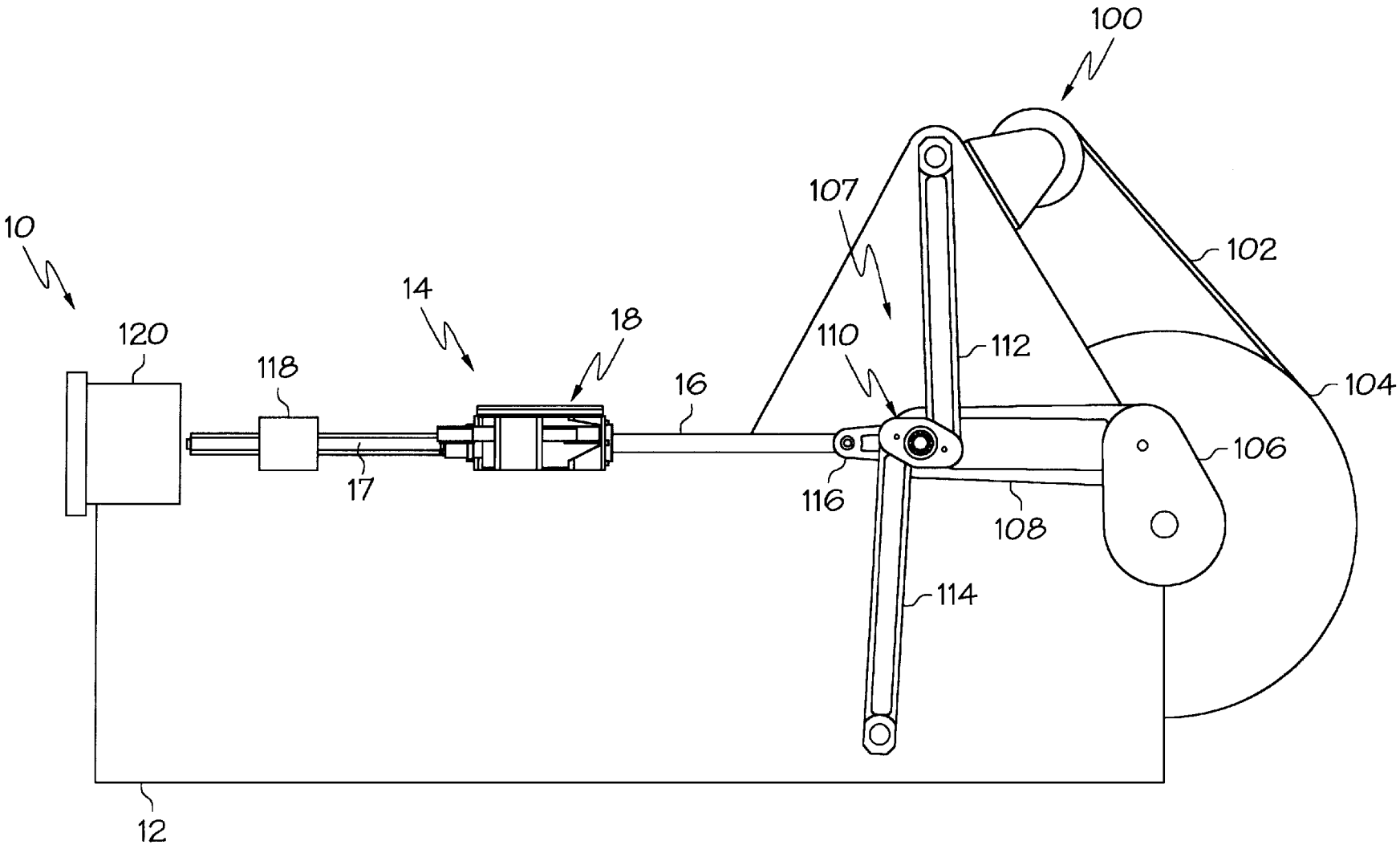
FIG. 1 is an elevational side view of a can body making apparatus in accordance with one exemplary embodiment of the present invention, wherein portions of the frame and apparatus are not shown for clarity.

Turning now to the drawing figures in detail, wherein like numbers indicate like elements among corresponding views, reciprocation apparatus including a guide assembly are provided. As illustrated in FIG. 1, the reciprocation apparatus may take the form of a can body making apparatus 10. It is understood that the reciprocation apparatus can take many other forms and is not necessarily limited to use in a can body making apparatus. For instance, the present concepts of the invention can include any reciprocation apparatus including a frame and a reciprocation assembly with an elongated member adapted to reciprocate relative to the frame, and a guide assembly adapted to guide the elongated member.

Figure 2:
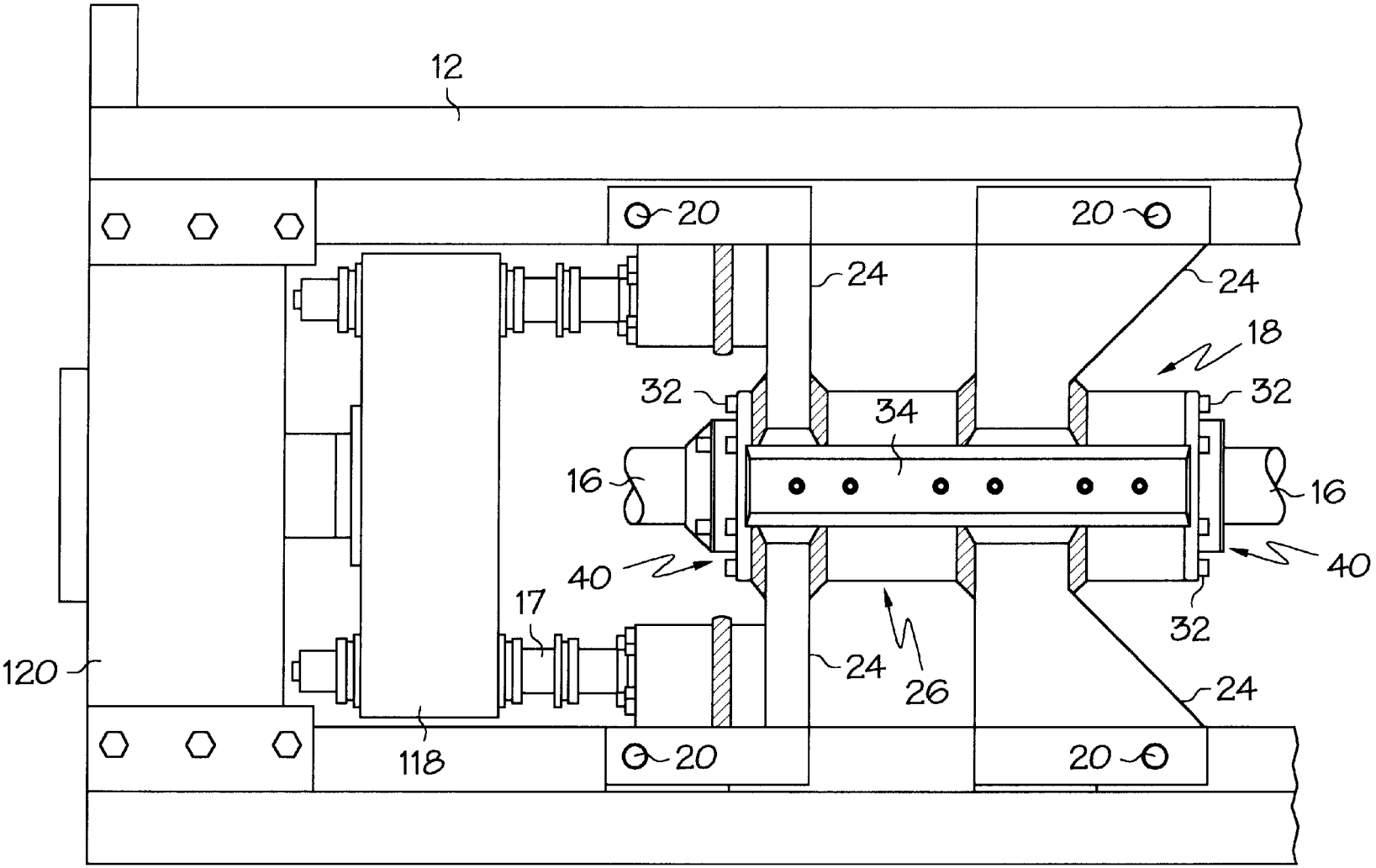
FIG. 2 is a top plan view of portions of the can body making apparatus of FIG. 1.

One exemplary embodiment of a can body making apparatus 10 is illustrated in FIG. 1. As illustrated in FIG. 1, the can body making apparatus 10 includes a frame 12 and a reciprocation assembly 14. The reciprocation assembly 14 includes a ram 16 adapted to reciprocate relative to the frame 12. It is understood that a "ram" can be any elongated member of various cross-sectional shapes. For example, as best illustrated in FIGS. 1 and 2, the ram can be an elongated member with a circular cross-section.

The reciprocation assembly 14 further includes a guide assembly 18 adapted to guide the ram 16 for reciprocation relative to the frame 12. It is understood that the ram 16 and guide assembly 18 arrangement illustrated in the figures are of exemplary nature only and the other arrangements may be provided. One exemplary arrangement, as illustrated in FIG. 2, presents the guide assembly 18 being rigidly attached to the frame 12 with fasteners such as bolts 20. It is understood that other fasteners or other mechanical fastening devices may be used in exemplary embodiments wherein the guide assembly 18 is rigidly attached to the frame 12. For instance, the guide assembly could be attached to the frame by welding, gluing, or other fastening arrangement. As illustrated in the exemplary embodiment of FIGS. 1 and 2, the ram 16 reciprocates relative to the frame 12 such that portions of the ram 16 moves through and relative to the guide assembly 18.

Although not shown, other embodiments may include a guide assembly that is not rigidly attached to the frame but reciprocates relative to the frame as it is guiding the reciprocation member. For example, the guide assembly could be adapted to reciprocate relative to both the frame and the reciprocation member. In other embodiments, the guide assembly could be rigidly attached to the reciprocation member while the guide assembly and reciprocation member are adapted to unitarily reciprocate relative to the frame.

Figure 3:
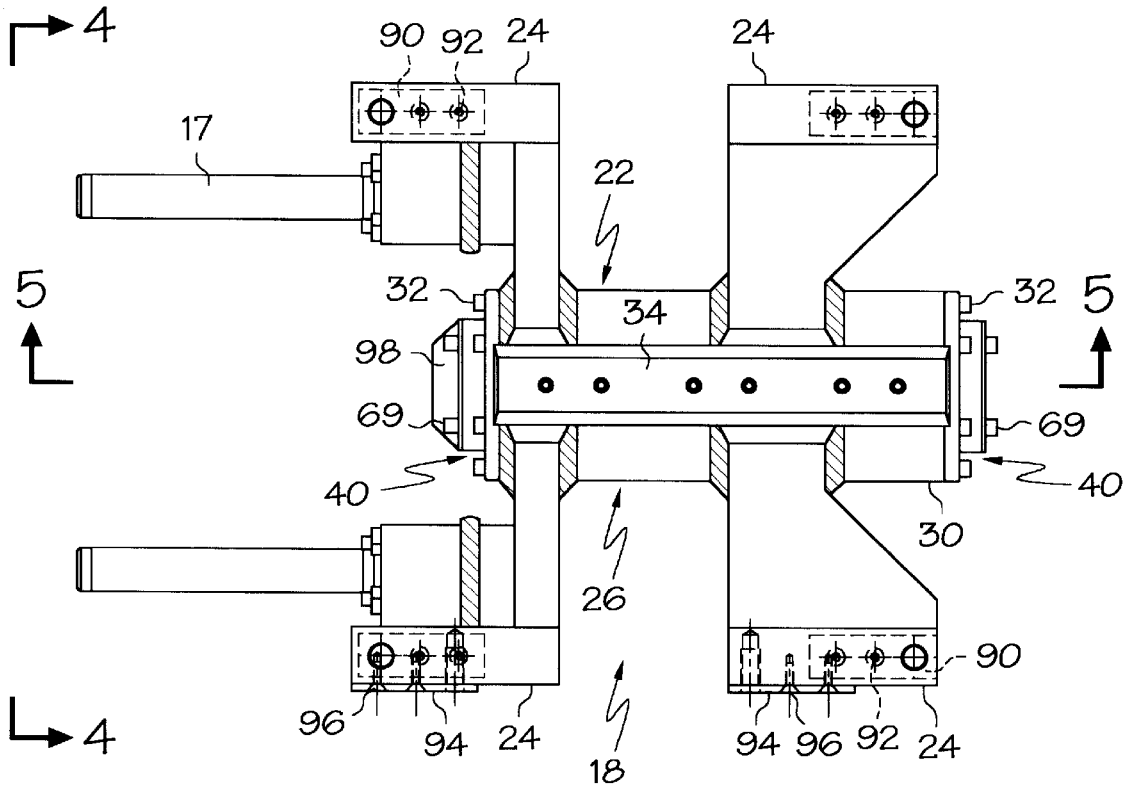
FIG. 3 is a top plan view of the guide assembly of FIG. 1, in accordance with one exemplary embodiment of the present invention.
Figure 4:
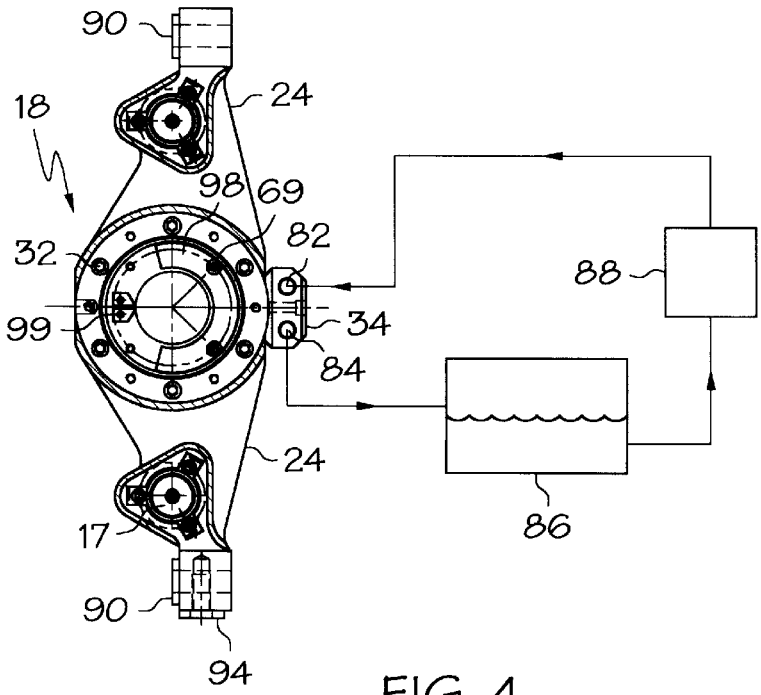
FIG. 4 is an end view of the guide assembly taken along line 4—4 in FIG. 3.

Turning now to FIGS. 3 and 4, the exemplary guide assembly 18 includes a main body portion 22 with four arms 24 extending outwardly from a central body portion 26. Regarding embodiments where the guide assembly 18 is rigidly attached to the frame 12, it is understood that any number of arms 24 or connection points may be used to connect the guide assembly 18 to the frame 12. The guide assembly 18 may also include one or more cartridges 40 mounted to the central body portion 26. In one example, as illustrated in FIG. 3, the guide assembly 18 may include two cartridges 40 mounted at opposing ends of the central body portion 26 with fasteners 32, such as bolts. Although not shown, it will be understood that three or more cartridges 40 may be provided depending upon the particular application and may be useful to further distribute stress throughout the guide assembly 18.

Figure 5:
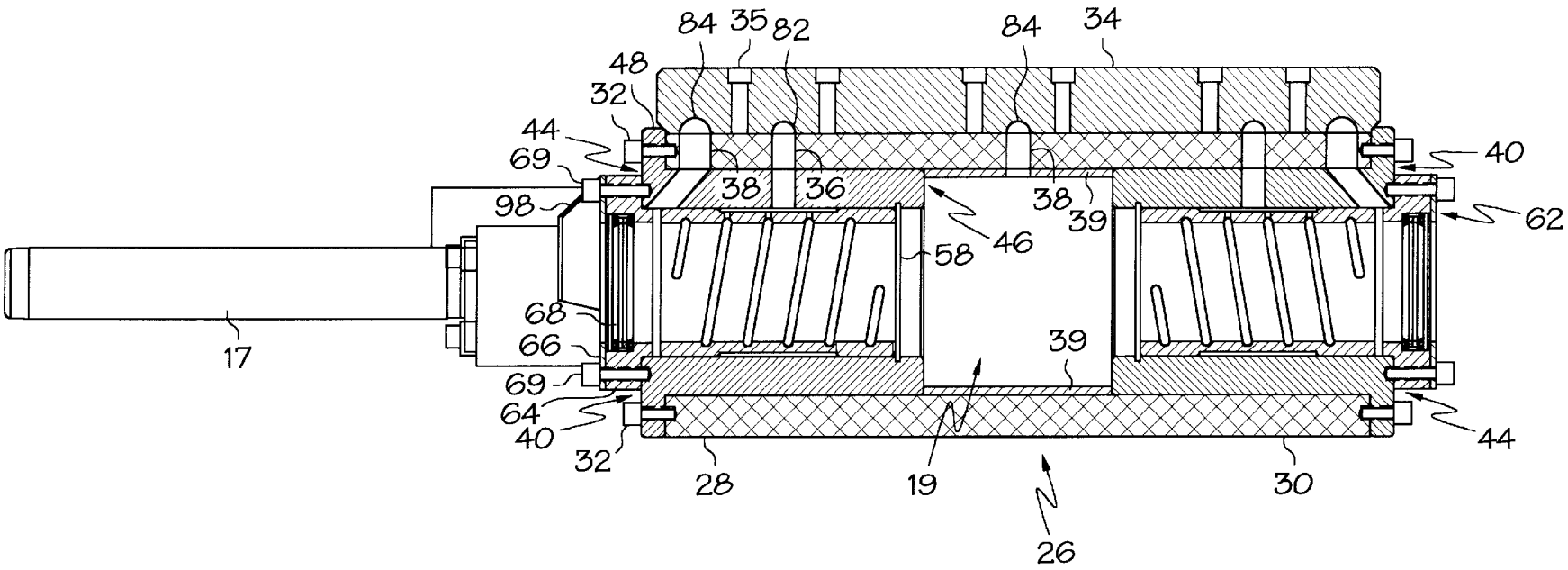
FIG. 5 is a cross sectional view of the guide assembly taken along line 5—5 in FIG. 3.

FIG. 5 is a cross-sectional view of the guide assembly 18 along line 5—5 of FIG. 3 wherein the shafts of the fasteners 32 and 69 are shown for clarity. As illustrated in FIG. 5, the cartridges 40 can be located at the front end 28 and the rear end 30 of the central body portion 26. In particular, a first end 44 of the cartridge 40 is fastened to the corresponding opposed ends 28, 30 of the central body portion 26. An optional spacer 39 may also be provided to provide axial support for the cartridges 40. The guide assembly 18 further comprises a manifold 34 for fastening to the central body portion 26 of the guide assembly 18. As best illustrated in FIG. 5, the manifold 34 may be attached to the central body portion 26 with one or more fasteners 35, such as bolts.

Figure 6:
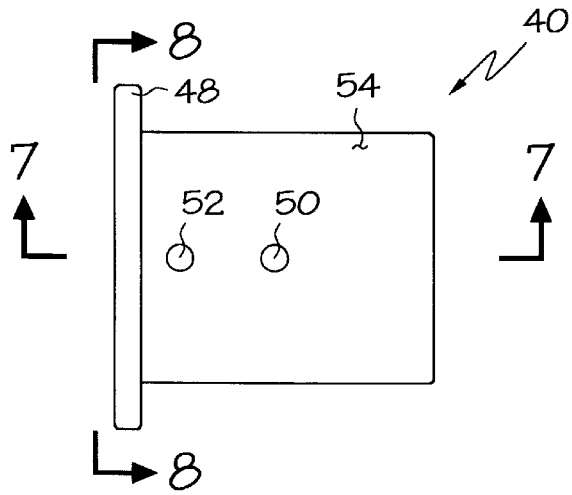
FIG. 6 is a top plan view of the cartridge illustrated in FIG. 5, in accordance with one exemplary embodiment of the present invention.

FIG. 6 illustrates a top plan view of one exemplary cartridge 40 in accordance with the present invention wherein a flange, such as a circumferential flange 48, is located at the first end 44 of the cartridge 40. As illustrated in FIG. 5, the cartridge 40 is adapted to be fastened to the main body portion 22 by fastening a bolt 32 through the flange 48. The cartridge 40 includes an outer surface 54 corresponding to a shape of a through passage 19 defined by the central body portion 26 of the guide assembly 18.

Figure 7:
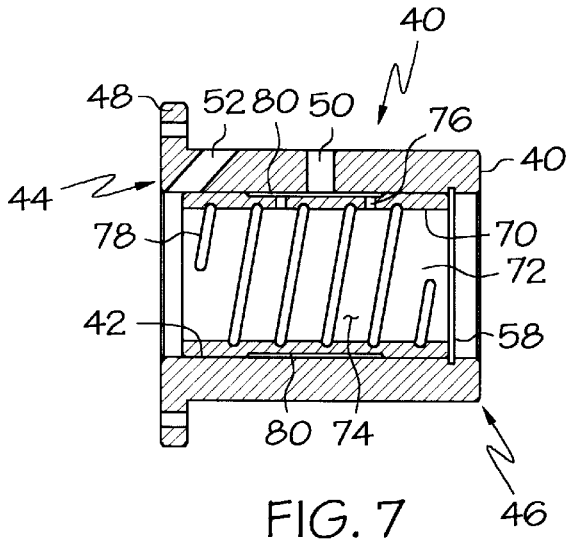
FIG. 7 is a cross sectional view of the cartridge taken along line 7—7 in FIG. 6.

As best illustrated in FIG. 7, a contact member 70 is disposed within a through hole 42 defined by the cartridge 40. The contact member 70 is disposed in and housed by a cartridge 40 such that the cartridge 40 houses and secures the contact member 70 to the guide assembly 18.

As illustrated in FIG. 5, the contact member 70 can be restrained within the cartridge 40 by a securing member 58 such as a snap ring at the second end 46 of the cartridge 40. An end cap assembly 62 may also be secured at the first end 44 of the cartridge 40 to further restrain the contact member 70 within the through hole 42 of the cartridge 40. The end cap assembly 62 includes and end cap member 64 and an end cap plate 66 for trapping a seal 68 within the end cap assembly 62. The seal 68 is provided to help prevent leakage of fluid from the guide assembly 18. A plurality of fasteners 69, such as bolts, attach the end cap assembly 62 to the first end 44 of the cartridge 40 while pressing the end cap plate 66 against the end cap member 64 to seat the seal 68 in place. A coating of material, such as TEFLON material, may be provided between mating parts to further provide a seal therebetween. For instance, a coating of TEFLON material may be provided between the abutting surfaces of the end cap assembly 62 and the cartridge 40.

As illustrated in FIG. 7, a contact member 70 includes an inner surface 74 that may define a helical groove 78 adapted to distribute fluid throughout the inner surface 74 of the contact member 70. A chamber 80 can be defined between the cartridge 40 and the contact member 70. As best illustrated in FIG. 7 for example, the chamber 80 may be annular and circumscribe the through hole 72 of the contact member 70. The chamber 80 is in fluid communication with a fluid inlet passage 50 defined in the cartridge 40. As best illustrated in FIG. 5, a fluid port, for example, fluid inlet port 36 in central body portion 26 is in fluid communication with the fluid inlet port 50 to provide fluid to the chamber 80. In addition, the fluid inlet port 36 of the central body portion 26 is in fluid communication with a fluid inlet port 82 of the manifold 34. As best illustrated in FIG. 7, at least one contact member passage 76 may be defined in the contact member 70 to allow fluid to pass from the chamber 80 to the inner surface 74 of the contact member 70.

In addition, the cartridge 40 may further define a fluid outlet passage 52 for fluid communication with fluid outlet port 38 defined in the central body portion 26 and a fluid outlet port 84 defined in the manifold 34.

As illustrated in FIG. 4, in use, fluid from a sump reservoir 86 passes through a filter 88, such as a schneider filter, and into the fluid inlet port 82 defined in the manifold 34. Turning now to FIG. 5, the fluid passes from the fluid inlet port 82 through the fluid inlet port 36 and into the fluid inlet passage 50 defined in the cartridge 40. Fluid then passes from the fluid inlet passage 50 into the annular chamber 80 to be distributed through one or more contact member passages 76 to the inner surface 74 of the contact member 70. Excess fluid may exit the guide assembly by passing through one or more fluid outlet ports 38 defined in the central body portion 26 to the fluid outlet port 84 defined in the manifold 34. The cartridge may also include a fluid outlet passage 52 to communicate with a corresponding one of the fluid outlet ports 38. As illustrated in FIG. 4, the fluid exiting the guide assembly 18 may be delivered from the fluid outlet port 84 to be recovered by the sump reservoir 86.

Figure 8:
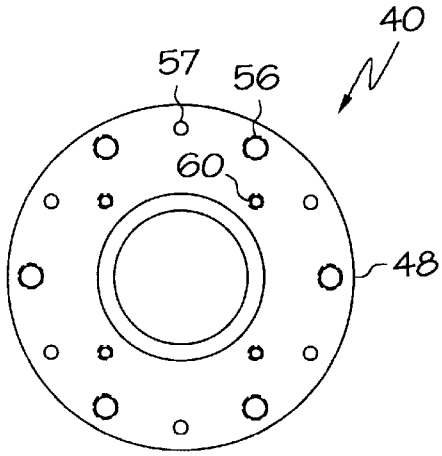
FIG. 8 is an end view of the cartridge taken along line 8—8 in FIG. 6.

As illustrated in FIG. 8, the flange 48 of the cartridge 40 may include one or more apertures 56 adapted to receive the fasteners 32 in order to removably attach the cartridge 40 to the main body portion 22. In addition, the cartridge 40 may further include one or more apertures 60 adapted to receive the fasteners 69 to removably attach the end cap assembly 62 to the cartridge 40. Optional threaded apertures 57 may also be defined in the flange 48, or other part of the cartridge 40, in order to allow jack screws (not shown) to assist in detaching the cartridge 40 from the main body portion 22 of the guide assembly 18.

As best illustrated in FIGS. 5 and 7, the contact member 70 may take the form of a contact sleeve. As shown, one particular embodiment of the sleeve has a circular cross-sectional shape adapted to receive a cylindrical ram. It will be understood that the sleeve could have other cross-sectional shapes corresponding to the shape of the ram. Moreover, certain embodiments of the present invention might involve a contact member in the form of a plate, U-shaped or V-shaped trough, or other surface for guiding a ram.

The contact member 70 can also comprise a material to reduce friction. It is desirable to fabricate the contact member 70 from a material with a relatively high PV value. The PV value equals the pressure between the surfaces multiplied by the relative velocity between the surfaces. The contact member(s) of the guide assembly should be able to withstand a relatively high PV value of at least 50,000–75,000 psi*ft/min without lubrication to reduce and/or entirely prevent degradation of the guide assembly and/or the ram in use.

For example, the contact member can comprise a material that can withstand a minimum PV value of 50,000 psi*ft/min without lubrication. In other embodiments, the contact member can comprise a material that can withstand a minimum PV value of 70,000 psi*ft/min without lubrication. In still further embodiments, the contact member can comprise a material that can withstand a minimum PV value of 75,000 psi*ft/min. Providing a material that can withstand such high PV values (e.g., materials capable of withstanding a minimum PV value of 75,000 psi*ft/min without lubrication) can eliminate the need for an external power source that would otherwise be required in other applications needing a preloaded bearing. In addition, such materials can allow the reciprocation assembly to operate without lubrication. Any optional lubrication or coolant provided could further enhance the longevity and removes additional heat created by the system. Moreover, with an optional fluid lubrication or coolant system, structural damage to the system will not result if the fluid flow is interrupted.

WEARCOMP polyimide, available from HyComp, Inc. located at 17960 Englewood Drive, Cleveland, Ohio 44130-3438, is one exemplary material that can be used for the contact member. WEARCOMP polyimide is a blend of highly thermally resistant polymer and long carbon fibers. The combination of polymer with long carbon fibers provides a material combination with increased mechanical strength and wear resistance at both room and elevated temperatures. WEARCOMP polyimide has a limiting PV value of 80,000 psi*ft/min with a coefficient of friction between 0.15 and 0.25. Other materials can be used for the contact member, such as FIBRECOMP polyimide also available from HyComp, Inc. FIBRECOMP polyimide has a limiting PV value of 120,000 psi*ft/min with a coefficient of friction of between 0.10 and 0.20. It is understood that the above materials are presented for exemplary purposes and that other materials may also be used that will allow the contact member to withstand a minimum PV value of 50,000–75,000 psi*ft/min without lubrication.

In one exemplary embodiment wherein the guide assembly 18 is rigidly attached to the frame 12, it is desirable to mount the guide assembly such that it is aligned with a die pack 120 to allow proper reciprocation of the ram 16 relative to the frame 12. In certain embodiments, a plurality of shims may be used to align the guide assembly. As best illustrated in FIGS. 3 and 4, each of the arms 24 may be provided with a lower shim 90 attached with fasteners 92 to the lower surface of the mounting portion of the arms. The shims may comprise a precision ground hardened metal. Fine adjustment may also be achieved with the use of a thin pealable shim. In addition, the arms of at least one side of the guide assembly 18 may also include one or more side shims 94 attached with fasteners 96 to a side surface of the arms 24 to allow lateral adjustment of the guide assembly 18 relative to the frame 12.

As illustrated in FIGS. 3–5, the guide assembly may further include a shield 98 adapted to reduce or prevent contaminants from falling onto the ram 16 and thereafter entering into the guide assembly 18. The guide assembly may also include a mechanism 99, such as a tear off clip, to prevent jamming of stock material. For instance, the tear off clip 99 could comprise a knife or blade adapted to cut aluminum stock to prevent jamming in use.

In use, a drive mechanism such as a motor 100 transmits torque with a belt 102 to a pulley wheel 104. Crank arms 106 attached to the pulley wheel 104 transmits force through a linkage apparatus 107 to the ram 16. The linkage apparatus 107 includes a main connecting rod 108 attached to a journal assembly 110. Idler arms 112 and 114 permit linear movement of a connecting link 116 that attaches the journal assembly 110 to the ram 16. Accordingly, as the pulley wheel 104 rotates, the linkage assembly 107 causes the linear reciprocation of the ram 16 relative to the frame 12. Many exemplary linkage assemblies could be used. For example, the linkage assembly of U.S. Pat. No. 3,696,657 could be used which is herein incorporated by reference. Moreover, the linkage assembly disclosed in copending Design application Ser. No. 29/140,241, titled "Linkage Apparatus" and filed Apr. 13, 2001 could also be used and is herein incorporated by reference.

A can holding mechanism 118 also reciprocates relative to the frame 12 to hold a can blank until the ram 16 forces a can blank held by the can holding mechanism 118 through a die pack 120 wherein the can body is formed from the can blank. As best illustrated in FIG. 2, the can holding mechanism 118 reciprocates along guide posts 17 of the guide assembly. Although not shown, any conventional reciprocation apparatus could be used to permit reciprocation of the can holding mechanism 118 relative to the frame 12. For instance, the reciprocation apparatus of U.S. Pat. No. 3,696,657 could be used which is herein incorporated by reference.

Using a removable cartridge 40 simplifies the replacement of the cartridges 40 since the entire guide assembly 18 does not have to be removed in order to repair a damaged or worn contact surface. In addition, use of a material, such as polyimide, capable of withstanding PV values of at least 50,000–75,000 psi*ft/min will allow a low pressure source of lubrication fluid to be used rather than a high pressure source and moreover will prevent waste by allowing recovery of excess fluid for recirculation through the fluid circuit. In addition, the entire fluid circuit is optional due to the material characteristics allowing the material to withstand relatively high PV values. If such a material is used, failure of any optional fluid lubrication system will not result in catastrophic damage to the system. Indeed, the system may be capable of operating for an extended period of time if not indefinitely without the fluid circuit when using a material capable of withstanding a minimum PV value of at least 50,000–75,000 psi*ft/min without lubrication.

If provided, the cartridge 40 may be removable from the main body portion 22 of the guide assembly 18. In order to remove the cartridge 40, the ram 16 may be removed from the guide assembly 18. The end cap assembly 62 may be removed from the cartridge 40 or the cartridge 40 may be removed from the main body portion 22 to replace the contact member 70. The entire cartridge 40 may be replaced or the cartridge may be repaired by replacing the contact member 70. By removing the cartridges 40 and/or contact members 70 rather than the whole entire guide assembly 18, down time is reduced by simplifying the replacement process and also since the guide assembly 18 does not have to be realigned with the die pack 120. Rather, the guide assembly 18 is left as previously correctly aligned with the die pack 120 and the cartridges and/or contact members are simply replaced to repair the guide assembly while maintaining proper alignment.

In exemplary embodiments, a guide assembly 18 is provided with a contact member 70 comprising a material capable of withstanding a minimum PV value of at least 50,000–75,000 psi*ft/min without lubrication. In these embodiments, a reciprocation assembly 14 is provided with a ram 16 and the guide assembly 18. The guide assembly 18 is adapted to guide the ram 16 for reciprocation relative to the frame 12. As illustrated in FIG. 2, the guide assembly 18 could be rigidly mounted to the frame 12 and be adapted to guide the ram 16 for reciprocation relative to the frame 12. In this embodiment, the contact member 70 can be provided for dynamically interfacing with at least a surface of the guide assembly 18 and/or the ram 16. In another embodiment, the guide assembly 18 could reciprocate relative to the frame 12. In this case, the contact member 70 can dynamically interface with at least a surface of the reciprocating assembly by placing the contact member between the guide assembly 18 and/or the frame 12. It is also contemplated that contact members 70 may be provided between the guide assembly 18 and the frame 12 and/or between the ram 16 and the guide assembly 18 in other exemplary embodiments.

The foregoing description of the various embodiments of the invention has been presented for the purposes of illustration and description. It is not intended to be exhaustive or to limit the invention to the precise form disclosed. Many alternatives, modifications and variations will be apparent to those skilled in the art of the above teaching. Accordingly, this invention is intended to embrace all alternatives, modifications and variations that have been discussed herein, and others that fall within the spirit and broad scope of the claims.

What is claimed is:

1. A can body making apparatus comprising:

a) a frame;

b) a contact member; and c) a reciprocation assembly comprising:

i) a ram mounted for reciprocation relative to the frame; and ii) a guide assembly adapted to guide the ram for reciprocation relative to the frame and including a removable cartridge adapted to restrain the contact member to the guide assembly, wherein the contact member is for dynamically interfacing with at least a surface of the reciprocation assembly, and wherein the contact member comprises a material capable of withstanding a minimum PV value of 50,000 psi*ft/min without lubrication.

2. The can body making apparatus of claim 1, wherein the contact member defines a helical groove.

3. The can body making apparatus of claim 1, wherein the contact member comprises a polyimide.

4. The can body making apparatus of claim 1, wherein the contact member comprises a contact sleeve.

5. The can body making apparatus of claim 4, wherein the contact sleeve defines a guide passage adapted to guide the ram.

6. The can body making apparatus of claim 5, wherein the guide passage comprises a through hole and wherein the ram is adapted to pass through the through hole.

7. The can body making apparatus of claim 1, wherein the cartridge includes a housing with a first end and a second end with a through hole extending from the first end to the second end and wherein the contact member is disposed in the through hole.

8. The can body making apparatus of claim 7, wherein the contact member includes an inner surface and wherein the housing includes a fluid inlet passage adapted to provide the inner surface with fluid.

9. The can body making apparatus of claim 8, wherein a cavity is defined between the contact member and the housing.

10. The can body making apparatus of claim 9, wherein the contact member defines a through hole.

11. The can body making apparatus of claim 10, wherein the cavity is annular and circumscribes the through hole of the contact member.

12. The can body making apparatus of claim 9, further comprising a fluid port in fluid communication with the fluid inlet passage to provide fluid to the cavity.

13. The can body making apparatus of claim 9, further comprising a contact member passage defined in the contact member adapted to allow fluid to pass from the cavity to the inner surface of the contact member.

14. The can body making apparatus of claim 1, wherein the contact member and the removable cartridge are adapted for common insertion and removal relative to the main body portion of the guide assembly.

15. A reciprocation apparatus comprising:

a) a frame;

b) a contact member; and c) a reciprocation assembly comprising:

i) an elongated member adapted to reciprocate relative to the frame; and ii) a guide assembly adapted to guide the elongated member, the guide assembly including a main body portion and a removable cartridge, wherein the cartridge houses the contact member and is adapted to secure the contact member relative to the guide assembly, wherein the contact member is for dynamically interfacing with at least a surface of the reciprocation assembly, and wherein the contact member and cartridge are adapted for common insertion and removal relative to the main body portion of the guide assembly.

16. The reciprocation apparatus of claim 15, wherein the contact member comprises a material capable of withstanding a minimum PV value of 50,000 psi*ft/min without lubrication.

17. The reciprocation apparatus of claim 16, wherein the contact member comprises a polyimide.

18. The reciprocation apparatus of claim 15, wherein the contact member defines a helical groove.

19. The reciprocation apparatus of claim 15, wherein the contact member comprises a contact sleeve.

20. The reciprocation apparatus of claim 15, wherein the cartridge includes a housing with a first end and a second end with a through hole extending from the first end to the second end and wherein the contact member is disposed in the through hole.

21. The reciprocation apparatus of claim 20, wherein the first end of the housing is attached to the main body portion of the guide assembly.

22. The reciprocation apparatus of claim 21, further comprising an end cap attached to the first end of the housing to assist in securing the contact member within the through hole of the housing.

23. A can body making apparatus comprising:

a) a frame;

b) a ram supported relative to the frame;

c) a drive assembly adapted to linearly reciprocate the ram relative to the frame;

d) a can holding mechanism for holding a can blank;

e) a die pack, wherein the ram member being operative to selectively contact and force a can blank held by the can holding mechanism through the die pack;

f) a contact member; and g) a guide assembly adapted to guide the ram, the guide assembly comprising a main body portion and a cartridge removably attached to the main body portion, wherein the contact member is disposed in and restrained by the cartridge, and wherein the contact member and cartridge are adapted for common insertion and removal relative to the main body portion of the guide assembly.

24. The can body making apparatus of claim 23, wherein the contact member comprises a material capable of withstanding a minimum PV value of 50,000 psi*ft/min without lubrication.

25. A can body making apparatus comprising:

a) a frame;

b) a first contact member; and c) a reciprocation assembly comprising:

i) a ram mounted for reciprocation relative to the frame; and ii) a guide assembly adapted to guide the ram for reciprocation relative to the frame and including a first removable cartridge adapted to restrain the first contact member to the guide assembly, wherein the first contact member is for dynamically interfacing with at least a surface of the reciprocation assembly.

26. The can body making apparatus of claim 25, wherein the guide assembly includes a body portion with a front end and a rear end and a through passage defined between the front end and the rear end.

27. The can body making apparatus of claim 26, wherein the first removable cartridge is removably mounted adjacent the front end of the body portion.

28. The can body making apparatus of claim 27, further comprising a second contact member and a second removable cartridge removably mounted adjacent the rear end of the body portion and adapted to restrain the second contact member to the guide assembly.

29. The can body making apparatus of claim 27, wherein the first cartridge includes a housing with a first end and a second end with a through hole extending from the first end to the second end, wherein the first contact member is disposed in the through hole and the second end of the first removable cartridge is disposed in the through passage of the body portion.

30. The can body making apparatus of claim 29, further comprising a second contact member and a second removable cartridge removably mounted adjacent the rear end of the body portion and adapted to restrain the second contact member to the guide assembly, wherein the second removable cartridge includes a housing with a first end and a second end with a through hole extending from the first end to the second end, and wherein the second contact member is disposed in the through hole and the second end of the second removable cartridge is disposed in the through passage of the body portion.

31. The can body making apparatus of claim 29, wherein the first end of the first cartridge is removably mounted to the front end of the body portion.

32. The can body making apparatus of claim 31, further comprising a first end cap member removably mounted to the first end of the first cartridge.

33. The can body making apparatus of claim 32, further comprising a first seal mounted with respect to the first end cap and adapted to contact the ram.

34. The can body making apparatus of claim 31, wherein the body portion includes a first fluid inlet passage adapted to provide an inner surface of the contact member with fluid.

35. The can body making apparatus of claim 34, wherein the housing of the first cartridge is provided with a fluid inlet passage in fluid communication with the first fluid inlet passage of the body portion.

* * * * *